US010666006B2

(12) United States Patent
Lin

(10) Patent No.: US 10,666,006 B2
(45) Date of Patent: May 26, 2020

(54) CRIMPING HAND TOOL

(71) Applicant: JETOOL CORP., New Taipei (TW)

(72) Inventor: Kai-Yen Lin, New Taipei (TW)

(73) Assignee: JETOOL CORP., New Taipei (TW)

( * ) Notice: Subject to any disclaimer, the term of this patent is extended or adjusted under 35 U.S.C. 154(b) by 209 days.

(21) Appl. No.: 15/970,889

(22) Filed: May 4, 2018

(65) Prior Publication Data

US 2019/0207355 A1 Jul. 4, 2019

(30) Foreign Application Priority Data

Dec. 28, 2017 (TW) ..... 106146119 A

(51) Int. Cl.

| | |
|---|---|
| ***H01R 43/042*** | (2006.01) |
| ***H01R 43/01*** | (2006.01) |
| ***H01R 24/64*** | (2011.01) |
| ***H01R 43/28*** | (2006.01) |
| ***H01R 107/00*** | (2006.01) |

(52) U.S. Cl.

CPC ..... *H01R 43/0421* (2013.01); *H01R 43/015* (2013.01); *H01R 24/64* (2013.01); *H01R 43/28* (2013.01); *H01R 2107/00* (2013.01)

(58) Field of Classification Search

CPC .. H01R 43/0421; H01R 43/015; H01R 43/28; H01R 24/64

See application file for complete search history.

(56) References Cited

U.S. PATENT DOCUMENTS

| | | | | |
|---|---|---|---|---|
| 10,439,352 | B2 * | 10/2019 | Cheng | H01R 43/048 |
| 10,490,963 | B2 * | 11/2019 | Hung | B25B 27/14 |
| 10,505,330 | B2 * | 12/2019 | Lin | H01R 43/015 |
| 2019/0363501 | A1 * | 11/2019 | Hung | H01R 43/0421 |

FOREIGN PATENT DOCUMENTS

| | | |
|---|---|---|
| CN | 201853926 | 6/2011 |
| TW | 499089 | 8/2002 |
| TW | M482893 | 7/2014 |
| TW | M547204 | 8/2017 |
| TW | M559529 | 5/2018 |

OTHER PUBLICATIONS

"Office Action of Taiwan Counterpart Application," dated Jul. 18, 2018, pp. 1-5.

* cited by examiner

*Primary Examiner* — David B. Thomas
(74) *Attorney, Agent, or Firm* — JCIPRNET

(57) ABSTRACT

A crimping hand tool used for crimping a cable and a housing together is provided. The crimping hand tool includes a first body, a second body pivoted to the first body, a linking member pivoted to the second body, a crimping assembly pivoted to the linking member and slidably coupled to at least a portion of a guiding structure of the first body, and a stripping assembly slidably disposed in the first body. The first and the second bodies are pivoted to be opened or closed relatively so as to drive the linking member and push the crimping assembly forward to crimp the cable and the housing together. The stripping assembly is suited for being forced to cut and peel off an insulated layer from conducting lines of the cable.

19 Claims, 14 Drawing Sheets

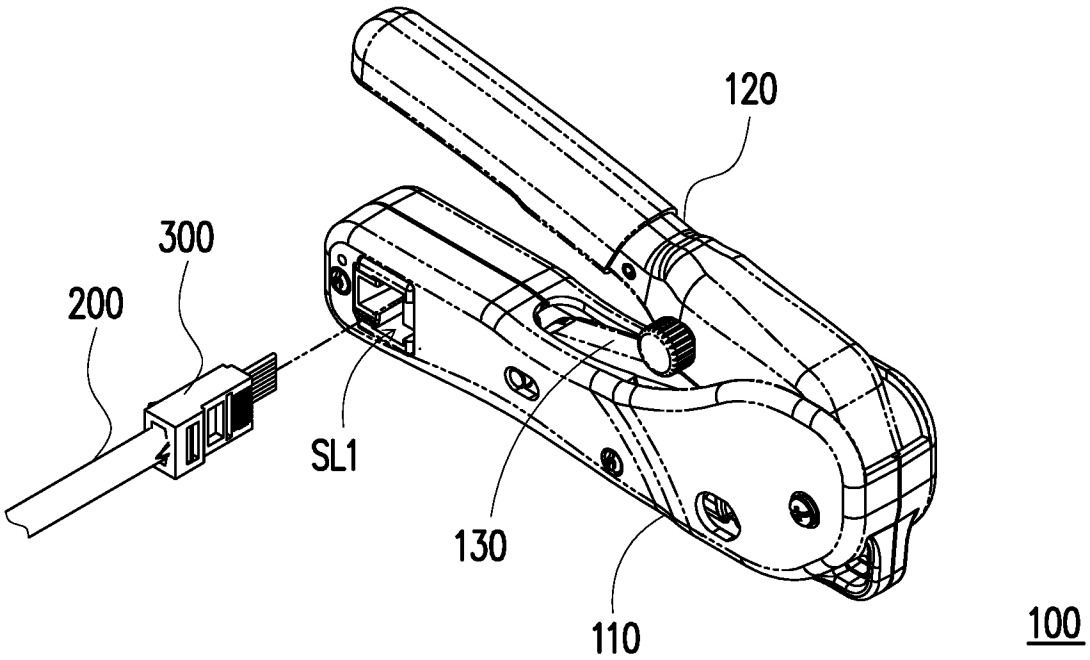
FIG. 1
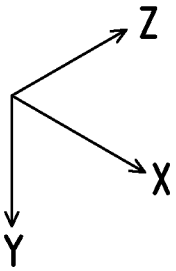

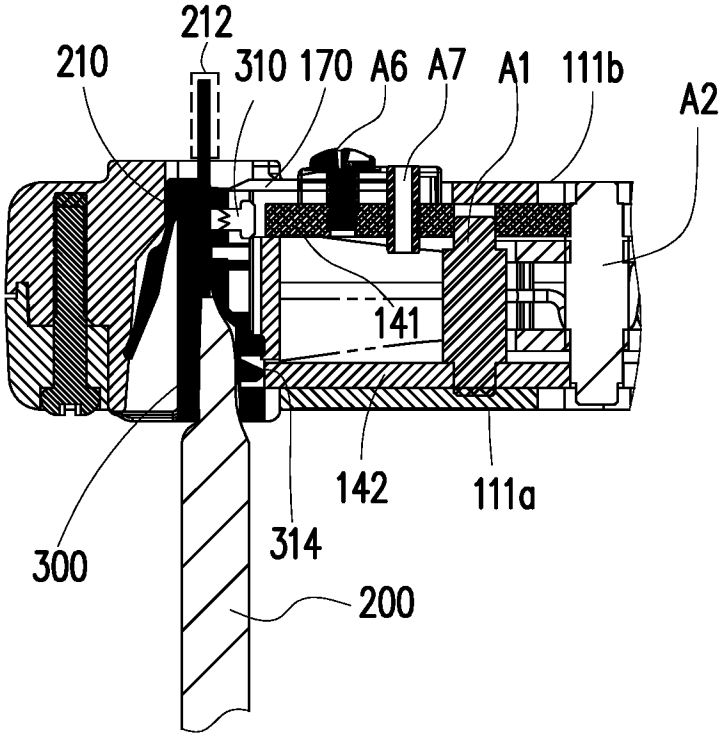
FIG. 3
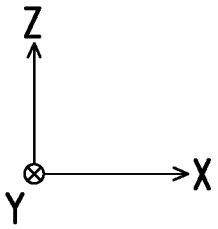

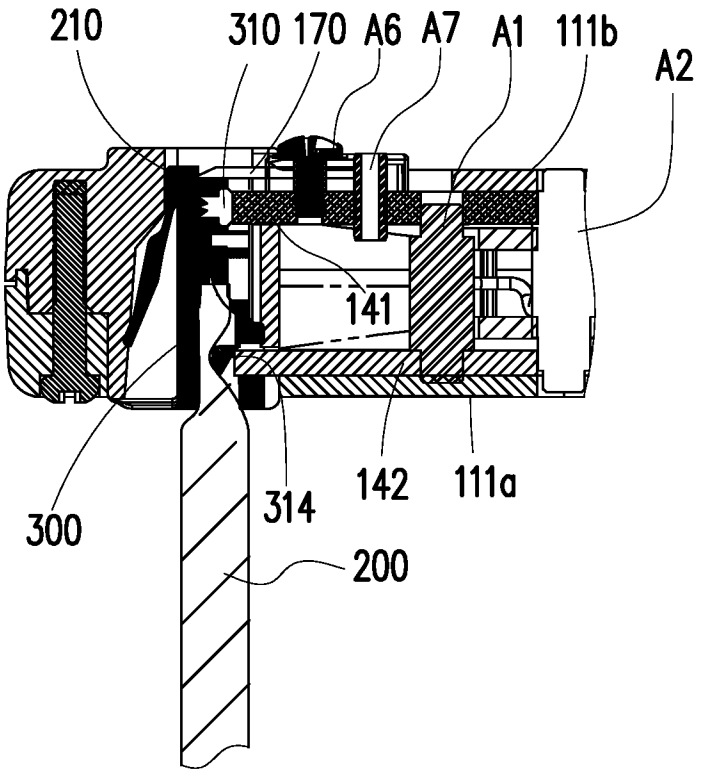
FIG. 4
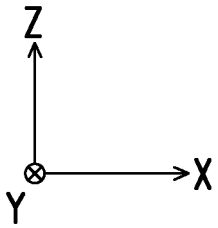

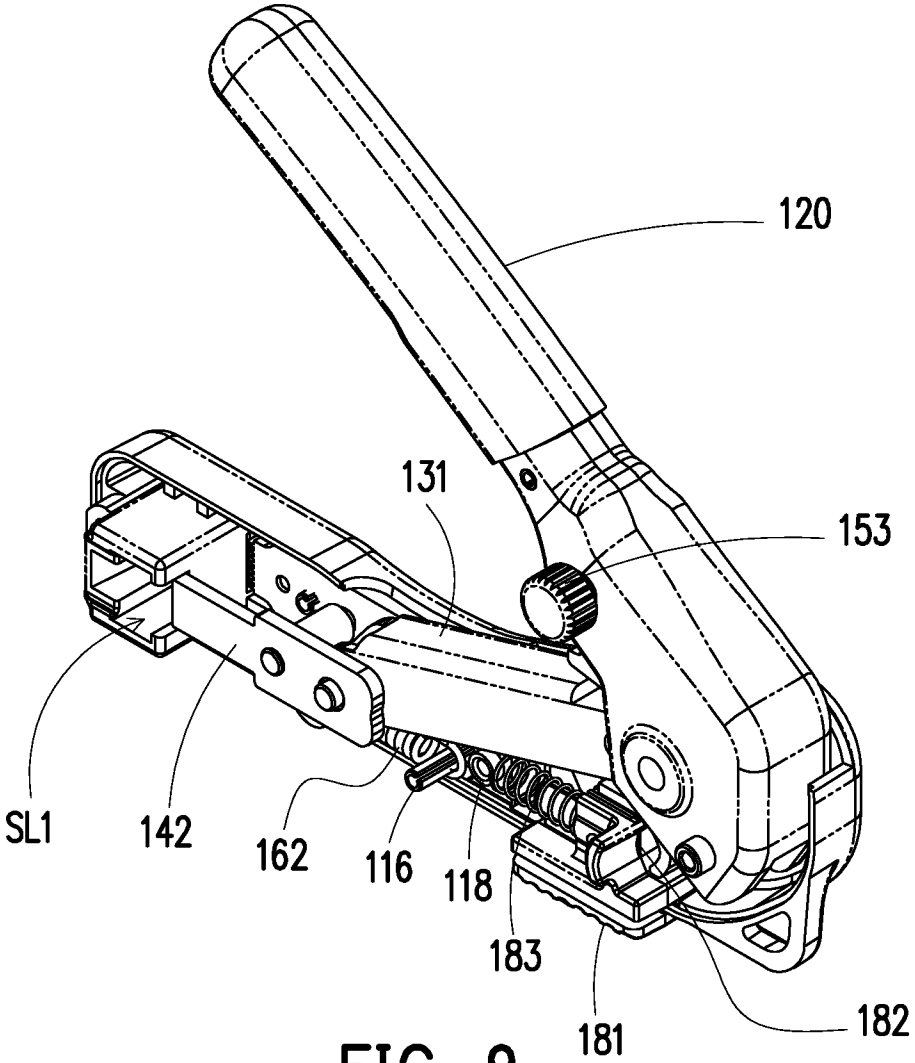
FIG. 9
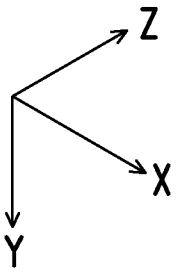

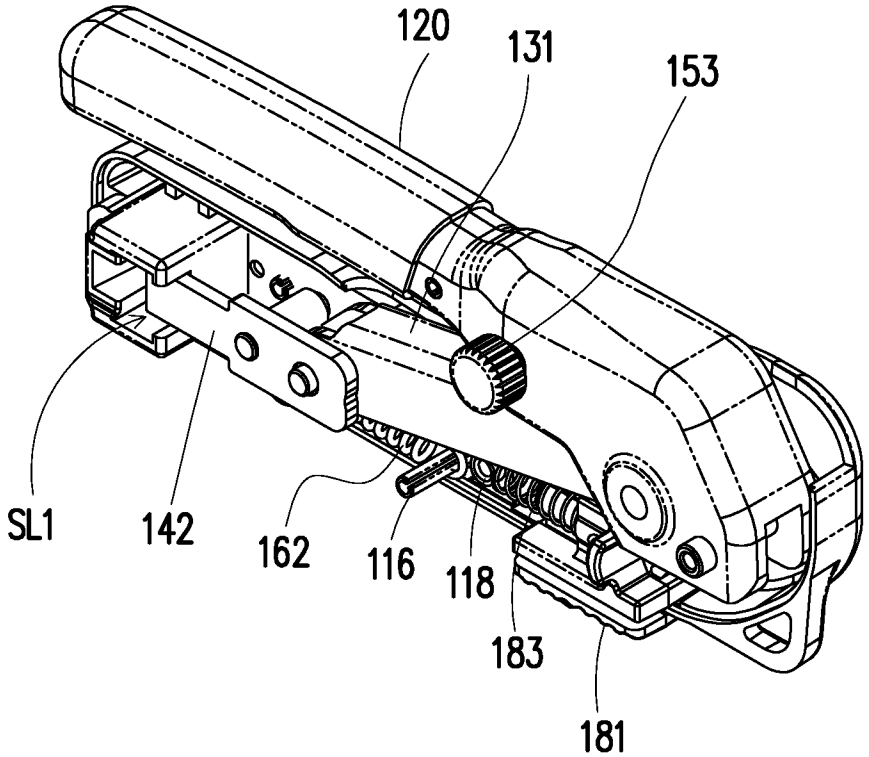
FIG. 10
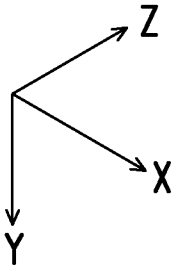

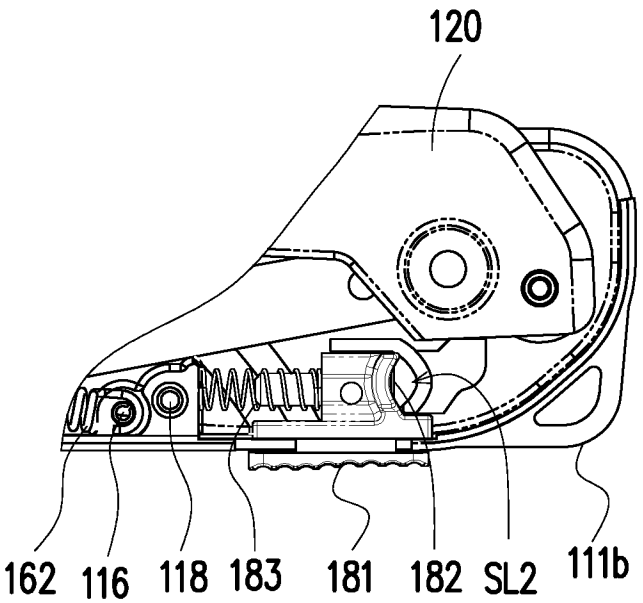
FIG. 12
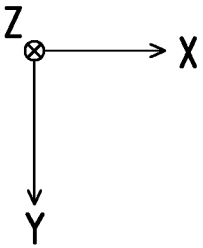

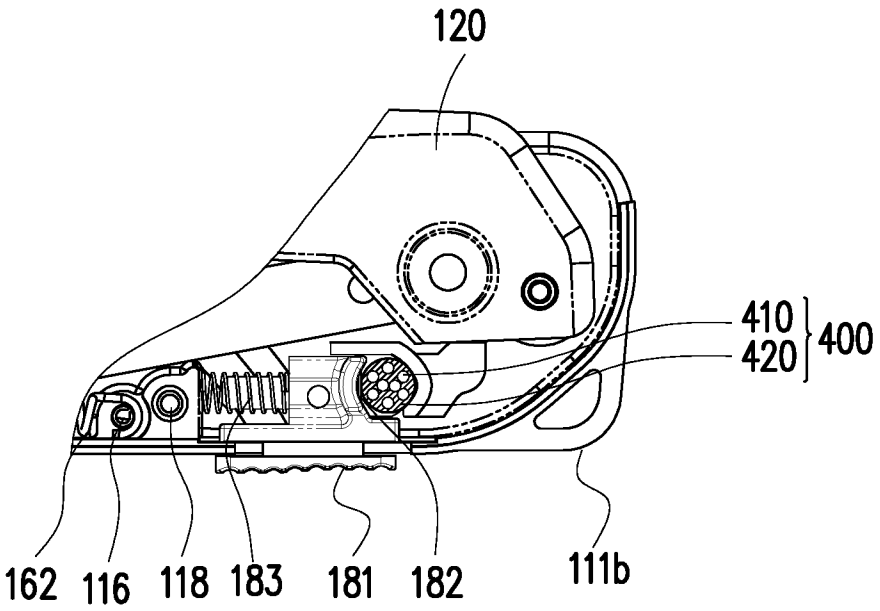
FIG. 14
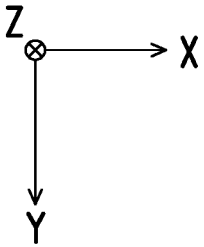

CRIMPING HAND TOOL

CROSS-REFERENCE TO RELATED APPLICATION

This application claims the priority benefits of Taiwan application serial no. 106146119, filed on Dec. 28, 2017. The entirety of the above-mentioned patent application is hereby incorporated by reference herein and made a part of this specification.

BACKGROUND

Field of the Invention

The invention relates to a crimping hand tool.

Description of Related Art

The signal transmission between electronic products, electronic devices, and electronic instruments is realized by connecting conductive lines, and conductive lines are usually connected to a connector and then connecting to another connector to achieve the effect of electrical connection.

Currently, a variety of signal wires and signal connectors have been widely used in signal transmission, such as a network cable together with an RJ45 connector for transmitting network signals and telephone line together with RJ11 connector for transmitting telephone signals. In order to connect the wire to the device, as required, the terminal end of the wire is usually connected to a corresponding housing to form a cable connector. Hence, a specific crimping hand tool is used to connect and fix the wire and the connector to each other.

SUMMARY

The invention provides a crimping hand tool which is configured to crimp a cable and a housing together to form a cable connector.

A crimping hand tool of the invention is configured to crimp a cable and a housing together, the crimping hand tool includes a first body, a second body, a linking member, a crimping assembly, and a stripping assembly. The first body has a guiding structure. The second body is rotatably coupled with the first body, so as to rotate to be opened or closed relative to the first body. The linking member is coupled with the second body. The crimping assembly is pivoted to the linking member and slidably coupled to at least a portion of the guiding structure. After the housing and the cable are placed into the first body, the second body is relatively closed to the first body to drive the crimping assembly to slide along the guiding structure through the linking member and to crimp the cable and the housing together. The stripping assembly is slidably disposed in the first body, the cable is adapted to pass through the first body and to be cut by the stripping assembly so an outer insulating jacket of the cable is stripped off from conducting lines of the cable.

Based on the above, the crimping hand tool has the first body and the second body rotatably coupled to each other, together with the linking member therebetween. When the first body and the second body rotate to be opened or closed with each other, the linking member can also rotate and slidably guide the crimping assembly through the guiding structure so as to drive the crimping assembly to perform axial movement, so that the signal/conductive lines and the housing are crimped to each other by the crimping assembly to form a cable connector. Additionally, the crimping hand tool further has the stripping assembly disposed in the first body. When the user wants to strip an outer insulating jacket of the cable, the cable is passed through the first body, and the outer insulating jacket of the cable is stripped off from the conducting lines of the cable by the stripping assembly, so the user can complete the crimping and stripping actions, as required, by using a single hand tool in order to improve the applicability of the crimping hand tool.

In order to make the aforementioned and other features and advantages of the invention more comprehensible, embodiments accompanying figures are described in detail belows.

BRIEF DESCRIPTION OF THE DRAWINGS

FIG. 1 is a schematic view of a crimping hand tool according to one embodiment of the invention.

FIG. 3 and FIG. 4 are partial schematic views of the operation of the crimping hand tool in FIG. 1.

FIG. 9 and FIG. 10 are respectively three-dimensional perspective views of the crimping hand tool in FIG. 1 at different states.

FIG. 12 to FIG. 14 are respectively schematic views of the crimping hand tool in FIG. 1 stripping a cable.

DESCRIPTION OF THE EMBODIMENTS

Figure 2:
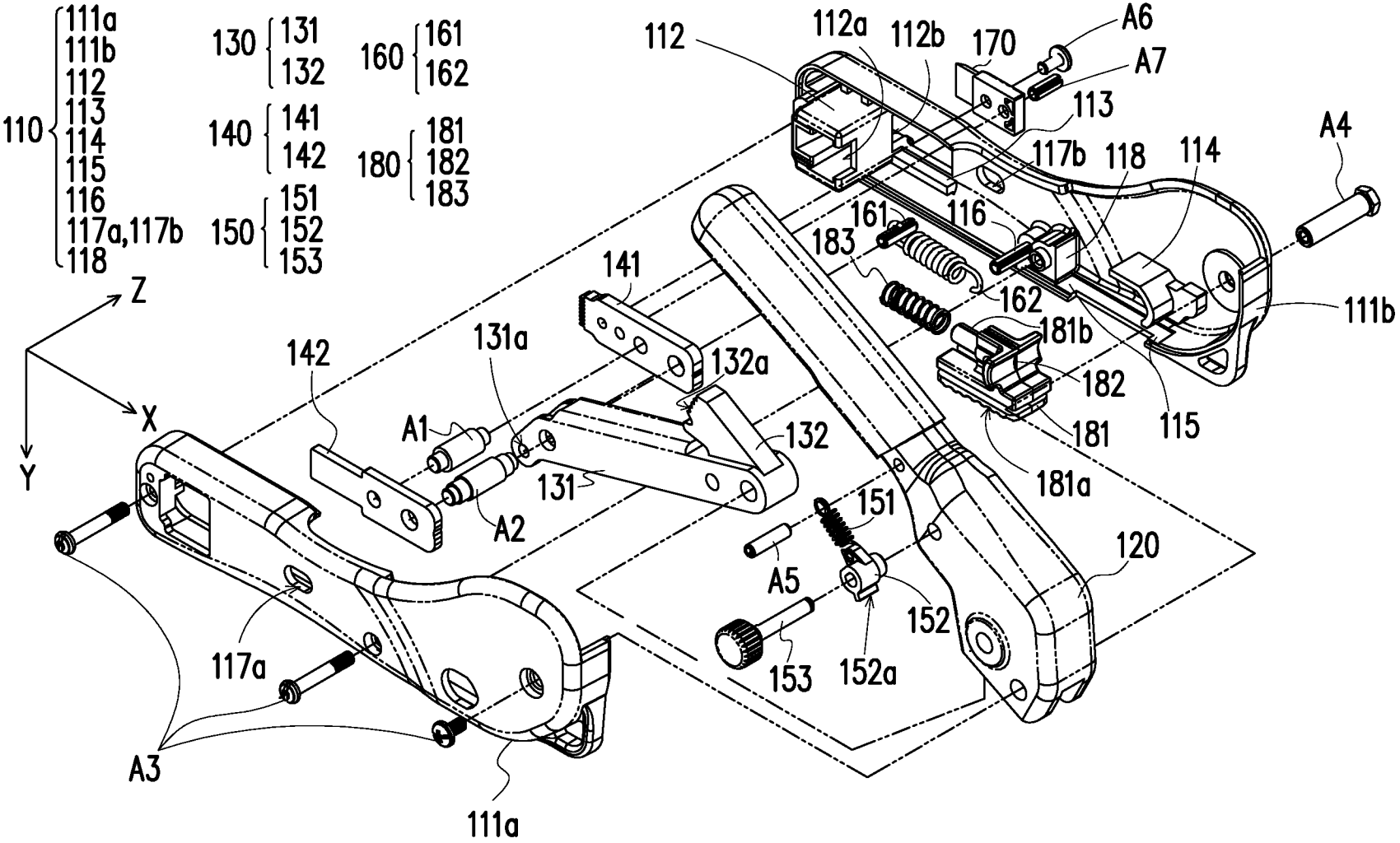
FIG. 2 is an exploded view of the crimping hand tool in FIG. 1.

FIG. 1 is a schematic view of a crimping hand tool according to one embodiment of the invention. FIG. 2 is an exploded view of the crimping hand tool in FIG. 1. Referring to FIGS. 1 and 2 simultaneously, in the present embodiment, a crimping hand tool 100 is configured to crimp a cable 200 and a housing 300 together, so as to form a cable connector. At the same time, a Cartesian coordinate system X-Y-Z is provided to better describe of the components. The crimping hand tool 100 includes a first body 110, a second body 120, a linking member 130, a crimping assembly 140, and a stripping assembly 180. The first body 110 has a guiding structure. The second body 120 is rotatably coupled with the first body 110, so as to rotate to be opened or closed relative to the first body 110. The linking member 130 is coupled with the second body 120. The crimping assembly 140 is pivoted to the linking member 130 and slidably coupled to at least a portion of the guiding structure. After the housing 300 and the cable 200 are together placed into a crimping slot SL1 of the first body 110, the second body 120 and the first body 110 receive a pressing force from an user to rotate and to be relatively closed to each other so as to drive the crimping assembly 140 to slide along the guiding structure through the linking member 130 and to crimp the cable 200 and the housing 300 together. Furthermore, the stripping assembly 180 is slidably disposed in the first body 110, the cable 200 is adapted to pass through the first body 110 and to be cut by the stripping assembly 180 so an outer insulating jacket is stripped off from conducting lines of the cable 200. The details will be explained step by step as follows.

Figure 5:
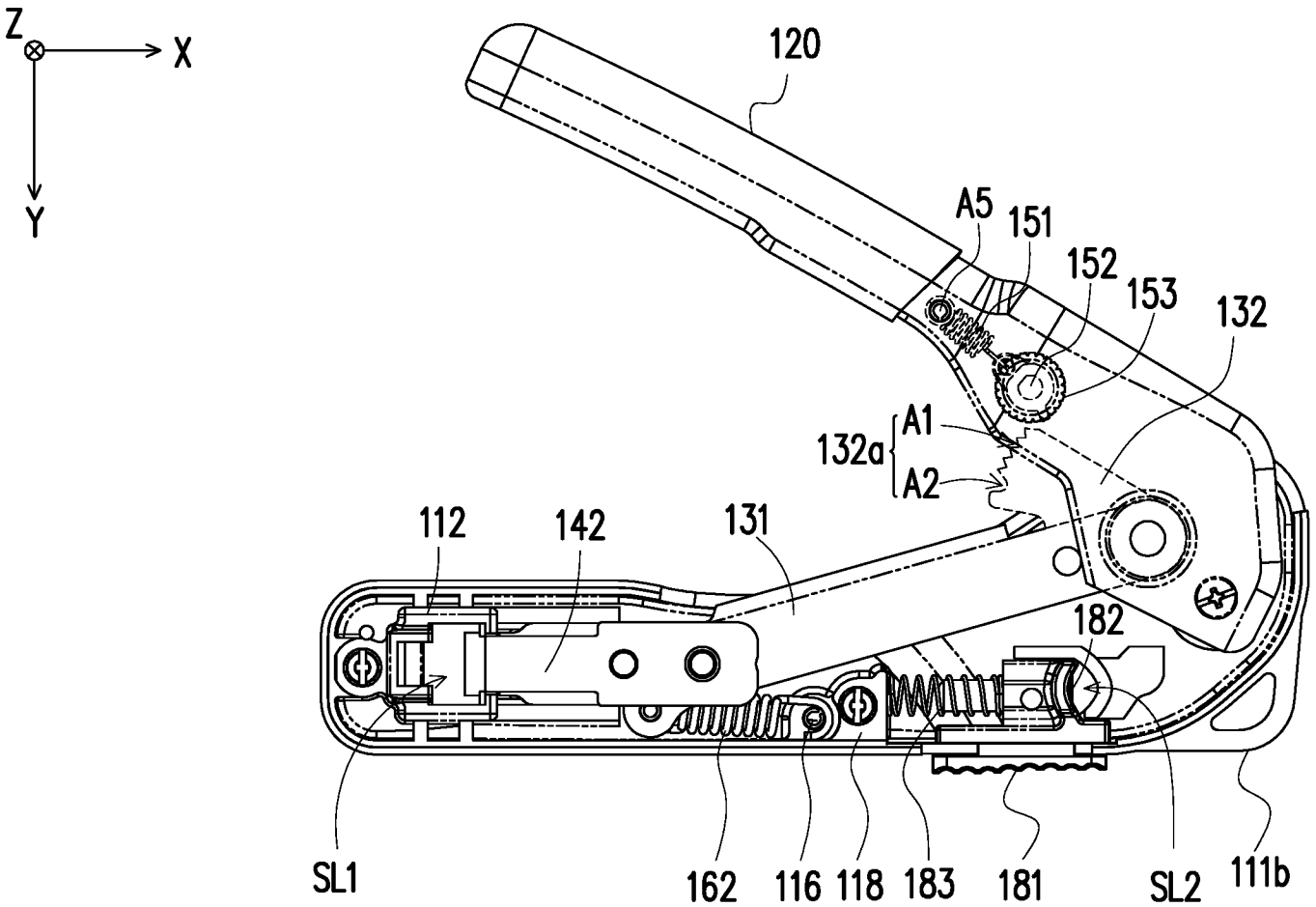
FIG. 5 to FIG. 7 are respectively schematic side views of the crimping hand tool in FIG. 1 at different states.

FIG. 3 and FIG. 4 are partial schematic views of the operation of the crimping hand tool in FIG. 1. FIG. 5 to FIG.

7 are respectively schematic side views of the crimping hand tool in FIG. 1 at different states. Referring to FIG. 2, FIGS. 3 to 4, and FIGS. 5 to 6, as shown in FIG. 2, the first body 110 includes a first casing 111*a*, a second casing 111*b*, and a guiding base 112, and the first casing 111*a* and the second casing 111*b* are assembled along the Z-axis to form an accommodating space, so that the guiding base 112 is located in the accommodating space. In here, the first casing 111*a*, the second casing 111*b*, and the guiding base 112 together form the crimping slot SL1, shown in FIG. 1, configured to guide the cable 200 and the housing 300 along the Z-axis to move in or out of the crimping slot SL1. The first casing 111*a* and the second casing 111*b* are combined with each other through connecting members A3 and A4, and the first casing 111*a* and the second casing 111*b* are pivoted to each other through the connecting member A4.

Next, the crimping assembly 140 includes a pair of crimping members 141 and 142 assembled together via a connecting member A1 and located on two opposite sides of the guiding base 112, and the pair of crimping members 141 and 142 are coaxially and pivotally connected to a body 131 of the linking member 130 through a connecting member A2. The guiding base 112 has guiding grooves 112*a* and 112*b* corresponding to the crimping members 142 and 141, respectively. Therefore, the crimping members 142 and 141 move along the guiding grooves 112*a* and 112*b* to be in or out of the crimping slot SL1. Accordingly, the guiding base 112 is considered as at least one portion of the guiding structure of the first body 110 and is configured to provide the crimping slot SL1 so the cable 200 and the housing 300 move along the Z-axis to enter and leave the crimping slot SL1 and the crimping members 141 and 142 move along the X-axis to enter and leave the crimping slot SL1. In another words, the guiding base 112 may be considered as having two guiding portions, one of the guiding portions is configured to guide the cable 200 and the housing 300, the other one of the guiding portions is configured to guide the crimping members 141 and 142, and two guiding directions of the two guiding portions are orthogonal to each other.

The type of the guiding structure of the first body 110 is not limited herein. As shown in FIG. 2, the connecting member A2 is used to pivotally connect the body 131 of the linking member 130 with the crimping members 141 and 142 and is slidably coupled to a reamed slot 117*a* of the first casing 111*a* and a reamed slot 117*b* of the second casing 111*b*. In other words, speaking of the first body 110, the reamed slots 117*a* and 117*b* are substantially regarded as passing through the first body 110, and the reamed slots 117*a* and 117*b* provide a guiding function for moving the connecting member A2 along the X-axis, so that the linking member 130 and the crimping assembly 140 move along the reaming direction of the reamed slots 117*a* and 117*b* to complete the crimping action. Therefore, the reamed slots 117*a* and 117*b* are also regarded as the guiding structure of the first body 110.

Otherwise, the first body 110 further includes a guiding rib 113 disposed on an inner side surface of the second casing 111*b* and adjacent to the guiding groove 112*b* of the guiding base 112, and the guiding rib 113 is used to provide a guiding effect for the crimping member 141 to enter or leave the crimping slot SL1. Accordingly, the first casing 111*a* has a structure similar to the guiding rib 113 and this structure is not shown in FIG. 2 because of the point of view, but this structure may be understood by the corresponding relationship of the second casing 111*b* and will not be repeated herein. Therefore, the guiding rib 113 may also be considered as guiding structure.

It should be noted here, the guiding base 112 of the present embodiment is a structure disposed at the second casing 111*b* to form an integral body, but the invention is not limited thereto. The guiding base 112 may be a component independent of the first casing 111*a* and the second casing 111*b*, or may be a structure integrally formed with the first casing 111*a*.

Figure 6:
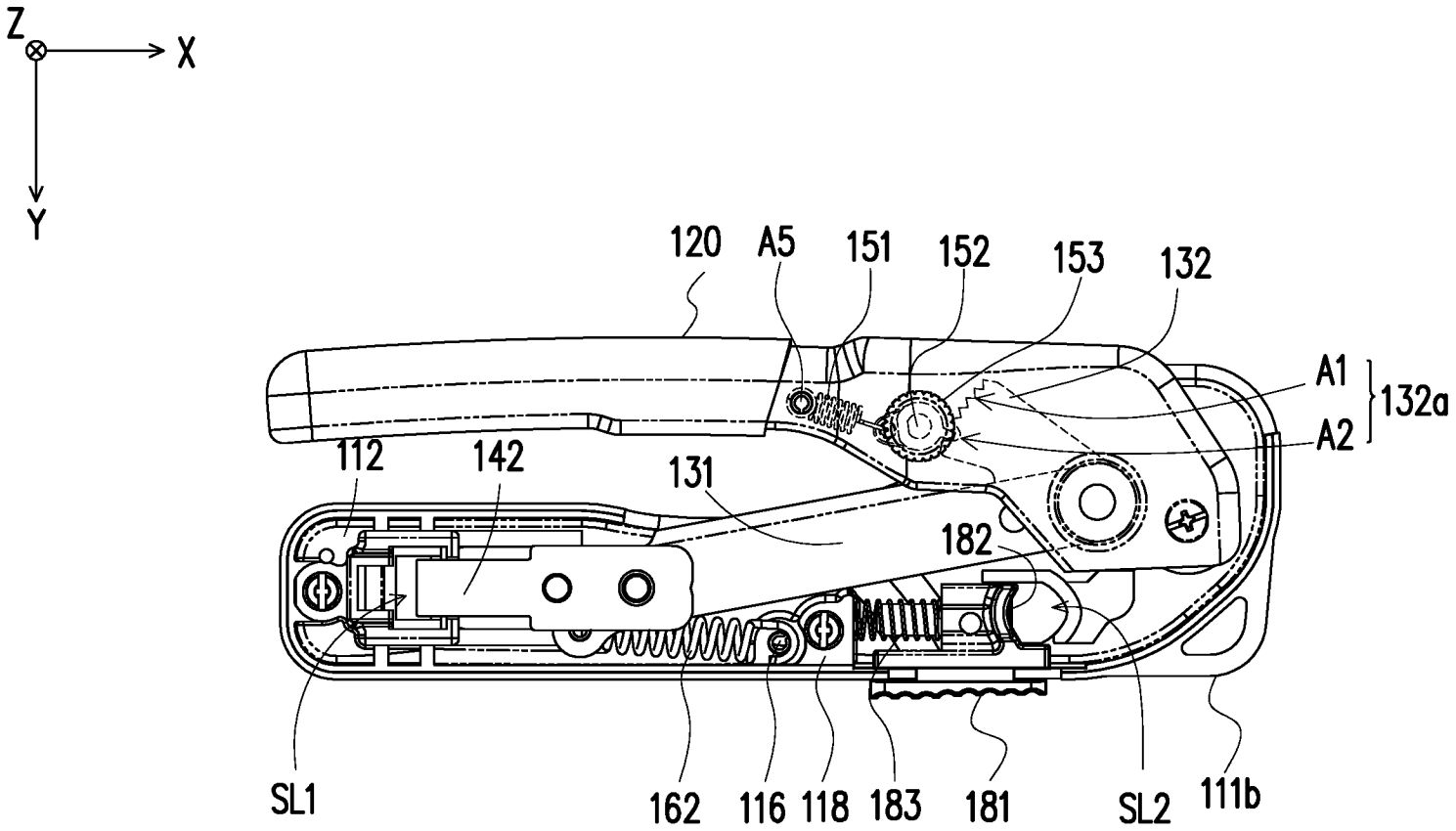

FIG. 9 and FIG. 10 are respectively three-dimensional perspective views of the crimping hand tool in FIG. 1 at different states which are corresponding to FIG. 5 and FIG. 6, the first casing 111*a* is omitted to better demonstrate movements of the linking member 130 and the crimping assembly 140. Referring to FIG. 5, FIG. 9, and corresponding FIG. 3, in the present embodiment, the user passes the cable 200 through the housing 300 first and then place the cable 200 and the housing 300 into the crimping slot SL1 through the guiding of the guiding base 112, as shown in FIG. 3. Next, the user applies force on the first body 110 and the second body 120 to rotate so as to become close to each other as shown in the state in FIG. 6, FIG. 10, and FIG. 4. This time, a conductive piece 310 is driven by the crimping member 141 to be crimped to the conducting line 210 of the cable 200, so the conductive piece 310 is electrically connected to the conducting line 210. At the same time, a crimping block 314 is crimped to the cable 200 (to the outer insulating jacket) by the crimping member 142, so the housing 300 and the cable 200 are fixed together.

It should be noted here, referring to FIG. 2, the crimping hand tool 10 further includes a first cutting tool 170 which is assembled to the crimping member 141 of the crimping assembly 140 through the connecting members A6 and A7 so as to move along with the crimping member 141. While the crimping assembly 140 performs the crimping action as above-mentioned, the first cutting tool 170 trims/cuts off an excess portion 212 of the conducting lines 210 protruding from the housing 300, so the residual conducting line portion of the cable connector in the housing 300 is aligned with the housing 300, as shown in the state in FIG. 4, and the crimping action of the cable 200 and the housing 300 is completed.

Referring to FIG. 2, FIG. 5, and FIG. 6, the crimping hand tool 100 of the present embodiment further includes a resetting assembly 160 which includes a connecting member 161 and a first elastic member 162, the connecting member 161 is disposed in a hole 131*a* of the body 131 of the linking member 130, and the first elastic member 162 is connected between the connecting member 161 and a protrusion 116 of the first body 110. Accordingly, when performing the crimping action, the linking member 130 is driven by the first body 110 to push the crimping assembly 140 moving into the crimping slot SL1, and since the connecting member 161 moves along with the body 131, the first elastic member 162 is stretched and deformed (as shown in FIG. 6). When the crimping action is completed and the user releases the force required for crimping, the first elastic member 162 can drive and reset the positions of the linking member 130 and the crimping assembly 140 so the linking member 130 and the crimping assembly 140 return to the positions in FIG. 5. In other words, the first elastic member 162 constantly drives the crimping assembly 140 to move away from a crimping slot SL1 of the first body 110 through the linking member 130.

Figure 7:
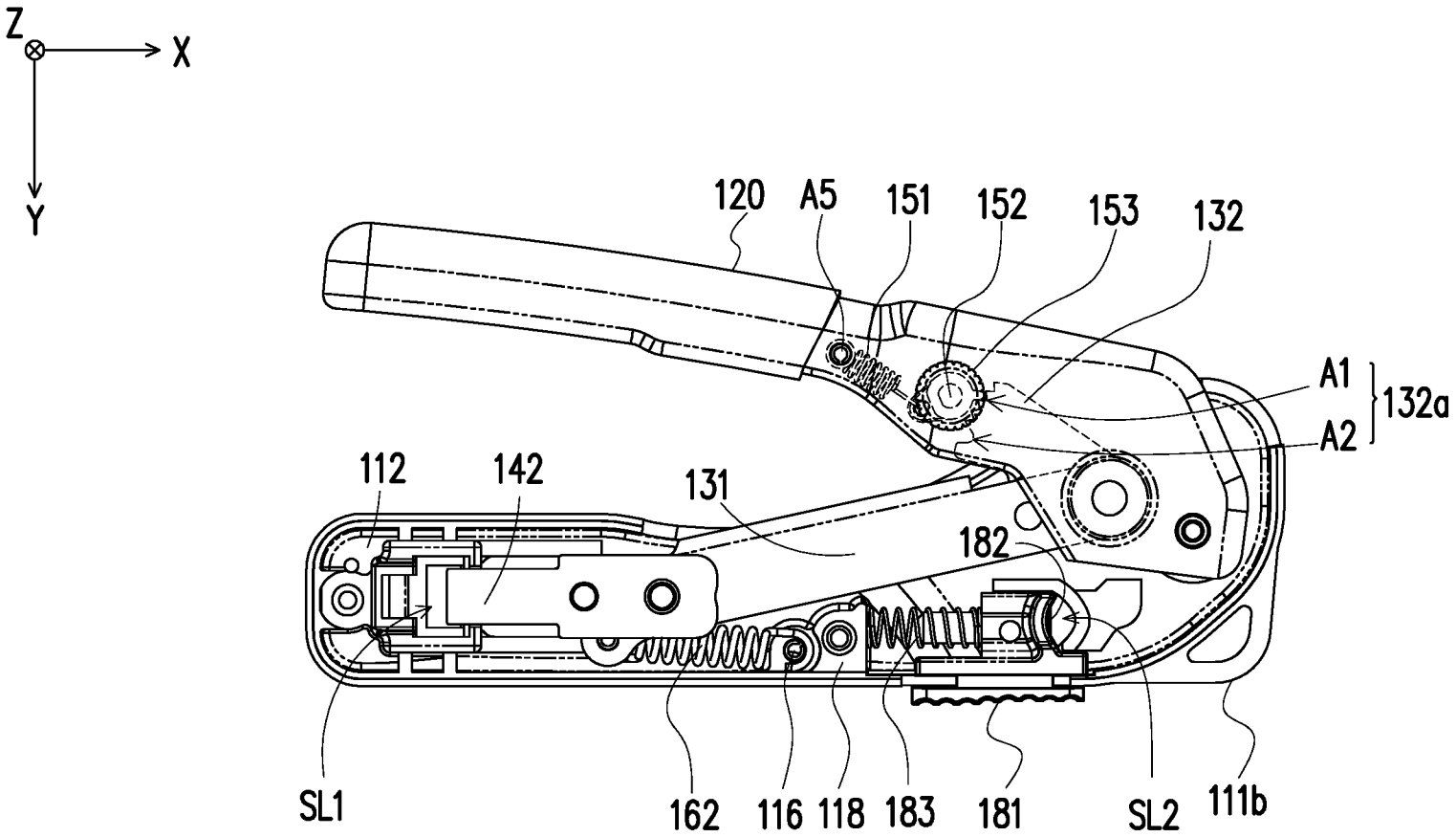

Referring to FIG. 2 and FIG. 7, the linking member 130 of the crimping hand tool 100 has a ratchet structure 132 adjacent to pivoting joint of the linking member 130 and the second body 120, a ratchet portion 132*a* of the ratchet structure 132 may be further divided into a first section E1 and a second section E2, and the first section E1 is a ratchet structure having higher density (than the second section E2). Accordingly, the crimping hand tool 100 further includes a stopping assembly 150 which includes a second elastic member 151, a stopping block 152, and a knob 153. The stopping block 152 may be rotatably disposed at the second body 120 through the knob 153, and the knob 153 is partially exposed to outside of the second body 120 so that the user can apply force to the knob 153 easily. One end of the second elastic member 151 is connected to the stopping block 152, and another end of the second elastic member 151 is connected to the second body 120 through the connecting member A5. Furthermore, a part (such as a protrusion 152*a* shown in FIG. 2) of the stopping block 152 interferes with a moving path of the ratchet structure 132. Therefore, during the process of rotating the first body 110 and the second body 120 to be opened with each other, the user can rotate the stopping block 152 by applying force to the knob 153 so that the stopping block 152 temporarily does not snap/hook with the ratchet structure 132, and the first body 110 and the second body 120 are temporarily fixed at an opened state as desired. As shown in FIG. 7, the protrusion 152*a* of the stopping block 152 snaps/hooks with the first section E1 of the ratchet portion 132*a* to be temporarily fixed. When releasing this state, the user only needs to apply force to the knob 153 so as to make the protrusion 152*a* move to the second section E2 and to release the snapping/hooking state as mentioned.

In addition, a direction that the second elastic member 151 drives the stopping block 152 is opposite to a direction that the ratchet structure 132 drives the stopping block 152. In other words, after the user driving the stopping block 152 to not snap/hook with the ratchet structure 132 through the knob 153, the stopping block 152 is driven by elastic force of the second elastic member 151 to rotate and return to original position.

Figure 8:
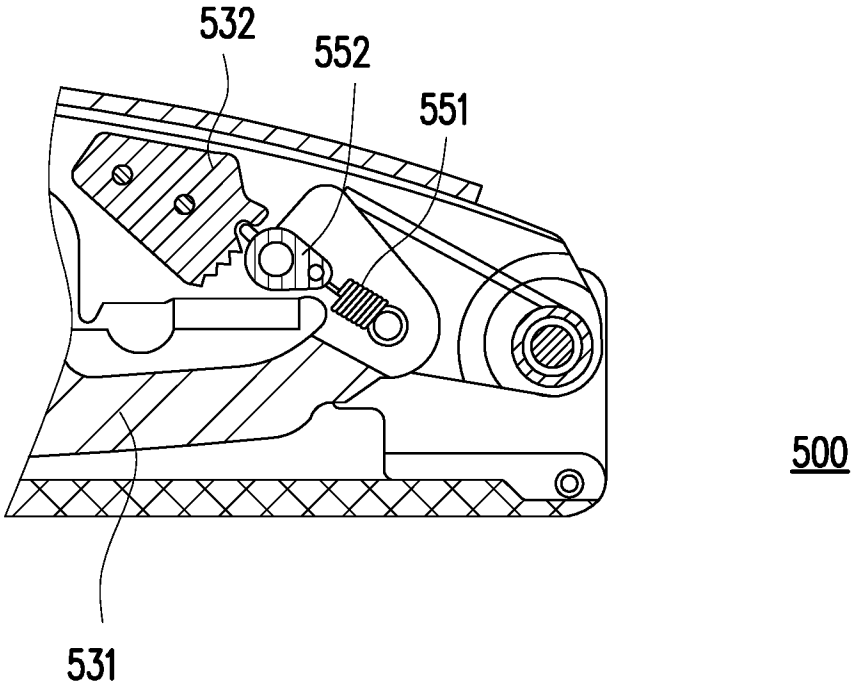
FIG. 8 is a partial cross-sectional view of a crimping hand tool according to another embodiment of the invention.

The disposing positions of the ratchet structure and the stopping assembly are not limited herein. FIG. 8 is a partial cross-sectional view of a crimping hand tool according to another embodiment of the invention. Referring to FIG. 8, the difference is that, in a crimping hand tool 500 of the present embodiment, a ratchet structure 532 is disposed at the second body (the upper part of the component shown in FIG. 8), and a stopping block 552 and a second elastic member 551 are disposed at a body 531 of the linking member, so as to be a structure that has opposite design with the aforementioned embodiment but still maintain the same snapping/hooking effect as the aforementioned embodiment.

Figure 11:
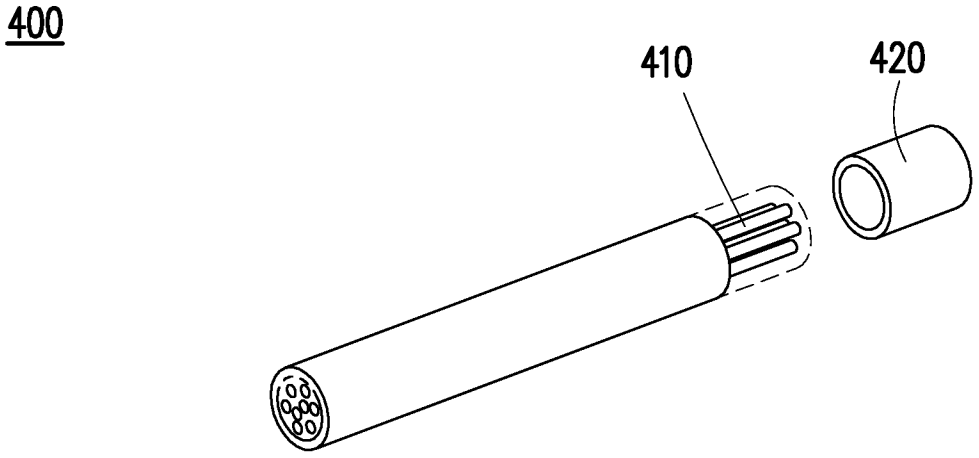
FIG. 11 is a schematic view of stripping a cable.
Figure 13:
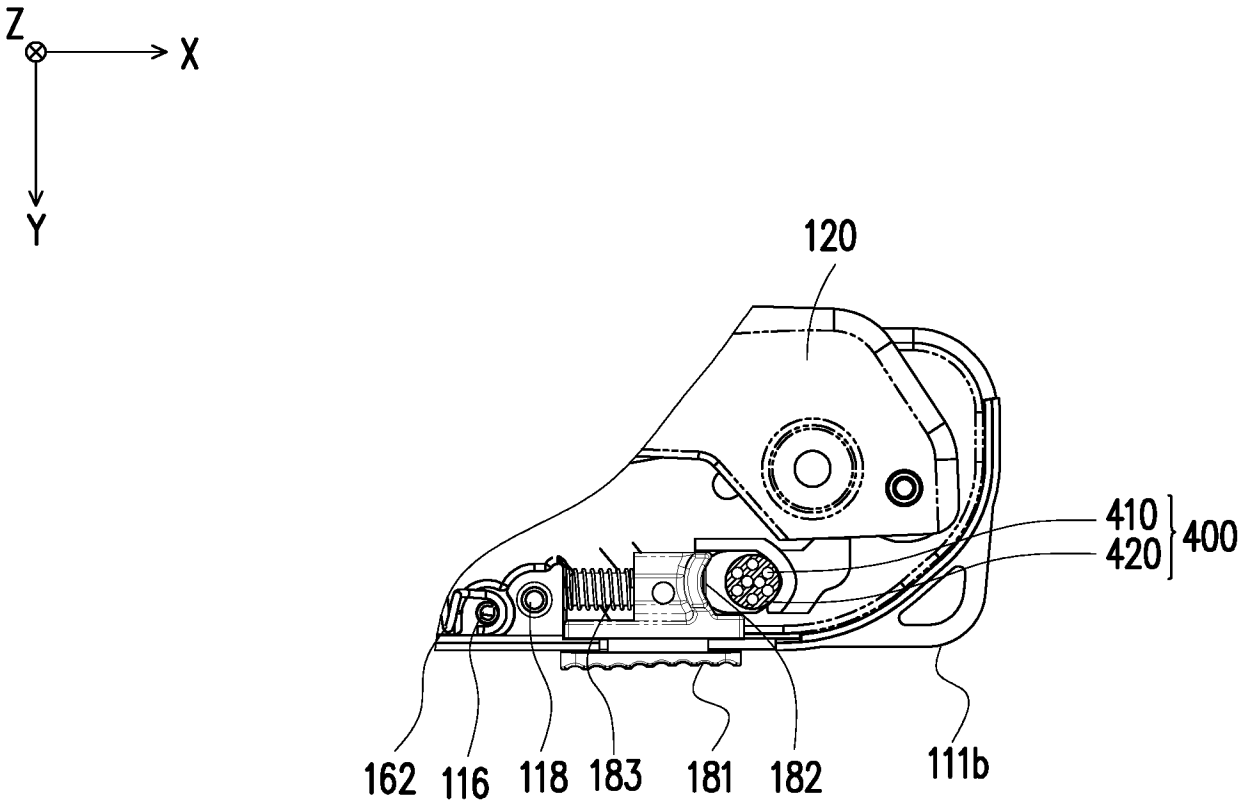

FIG. 11 is a schematic view of stripping a cable. FIG. 12 to FIG. 14 are respectively schematic views of the crimping hand tool in FIG. 1 stripping a cable. Referring to FIG. 2, in the present embodiment, the stripping assembly 180 includes a sliding member 181, a second cutting tool 182, and a third elastic member 183. The sliding member 181 may be slidably coupled to the sliding portion 115 (such as a lip portion having a slot formed therein) in the first body 110 along the X-axis, so that not only can the sliding member 181 be slidably clamped at the sliding portion 115, a pushing portion 181*a* of the sliding member 181 is exposed from the first body 110 to be easier applied force by the user. The second cutting tool 182 is embedded in the sliding member 181. Accordingly, the first body 110 also has a ribbed plate 114 located in the second casing 111*b* and corresponding to the sliding member 181, since the sliding member 181 and a corresponding part of the ribbed plate 114 together form a stripping slot SL2, the sliding member 181 moves along the X-axis to change the inner diameter of the profile of the stripping slot SL2 (shown in FIGS. 5-7). Furthermore, one end of the third elastic member 183 is sleeved onto a protruding column 181*b* of the sliding member 181, another end of the third elastic member 183 leans against a protrusion 118 of the first body 110, and the third elastic member 183 constantly drives the sliding member 181 to move closer to the ribbed plate 114.

As a result, as the process (stripping cable) shown in FIG. 12 to FIG. 14, before stripping the cable, the user applies force on the pushing portion 181*a* so as to drive the sliding member 181 to move in the negative X-axis direction. As shown in FIG. 12 to FIG. 13, the inner diameter of the stripping slot SL2 becomes greater than the diameter of the cable 400, so that it is easier for the user to plug the cable 400 into the stripping slot SL2. Next, the user releases the aforementioned force, so the third elastic member 183 drives the sliding member 181 to move towards the ribbed plate 114 (shown in FIG. 2), and the cable 400 is clamped between the sliding member 181 and the ribbed plate 114, as shown in FIG. 13 to FIG. 14. Accordingly, the second cutting tool 182 leans against the cable 400, and since the length of the portion (which is located in the stripping slot SL2) protruding from the sliding member 181 of the second cutting tool 182 is substantially smaller of equal to the thickness of the outer insulating jacket 420. Therefore, the aforementioned clamping action makes the second cutting tool 182 cut into the outer insulating jacket 420 of the cable 400. Certainly, the user can also apply force on the pushing portion 181*a* and drive the sliding member 181 to further move towards the ribbed plate 114 until the outer contour of the cable 400 leans against and matches the inner contour of the stripping slot SL2, so as to also make the second cutting tool 182 cut into the outer insulating jacket 420 but to avoid damaging the conducting line 410. Next, the user holds the cable 400 by one hand and rotates the crimping hand tool 100 along the outer contour of the cable 400 by the other hand (the cable 400 may be rotated instead of the crimping hand tool 100), so that the cable 400 is cut along the outer contour by the second cutting tool 182 in order to cut/strip the outer insulating jacket 420 off.

At this time, in order to conveniently dispose the stripping assembly 180 in the first body 110 and effectively reduce the volume for easy holding, a sliding axis of the stripping assembly 180 of the present embodiment and a sliding axis of the crimping assembly 140 are identical (such as the X-axis). The stripping assembly 180 is adjacent to a pivoting joint between the first body 110 and the second body 120, and the crimping assembly 140 is distant from the pivoting joint between the first body 110 and the second body 120, so the stripping assembly 180 is located between the crimping assembly 140 and the body of the pivoting joint, the sliding member 181 is located between the linking member 130 and the sliding portion 115 of the first body 110, and a sliding path of the sliding member 181 and a moving path of the linking member 130 do not overlap each other.

In summary, in the embodiments of the invention, the crimping hand tool has the first body and the second body pivotally connected to each other, together with the linking member therebetween. When the first body and the second body rotate to be open or closed with each other, the linking member can also rotate and slidably guide the crimping assembly through the guiding structure so as to drive the crimping assembly to perform axial movement, so that the signal/conductive lines and the housing are crimped to each other by the crimping assembly.

Additionally, the crimping hand tool further has the stripping assembly disposed in the first body. When the user wants to strip an outer insulating jacket of the cable, the cable is passed through the first body, and the outer insulating jacket of the cable is stripped off from the conducting lines of the cable by the stripping assembly, so the user can complete the crimping and stripping actions, as required, by using a single hand tool in order to improve the applicability of the crimping hand tool.

It will be apparent to those skilled in the art that various modifications and variations can be made to the structure of the invention without departing from the scope or spirit of the invention.

What is claimed is:

1. A crimping hand tool, configured to crimp a cable and a housing together, comprising:

a first body, having a guiding structure;

a second body, rotatably coupled with the first body to be opened or closed relative to the first body;

a linking member, coupled with the second body;

a crimping assembly, pivoted to the linking member and slidably coupled to at least a portion of the guiding structure, wherein after the housing and the cable are placed into the first body, the second body and the first body are moved to be relatively closed to each other to drive the crimping assembly to slide along the guiding structure through the linking member and to crimp the cable and the housing together; and a stripping assembly, slidably disposed in the first body, wherein the cable is adapted to pass through the first body and to be cut by the stripping assembly so an outer insulating jacket is stripped off from conducting lines of the cable.

2. The crimping hand tool as recited in claim 1, wherein a sliding axis of the stripping assembly and a sliding axis of the crimping assembly are identical.

3. The crimping hand tool as recited in claim 1, wherein the stripping assembly is adjacent to a pivoting joint of the first body and the second body, and the crimping assembly is distant from the pivoting joint of the first body and the second body.

4. The crimping hand tool as recited in claim 1, wherein the first body comprises:

a first casing;

a second casing, assembled to the first casing; and a guiding base, disposed in an accommodating space after the first casing and the second casing are assembled, wherein the guiding base has a portion of the guiding structure, and the at least one of the first casing and the second casing has other portion of the guiding structure.

5. The crimping hand tool as recited in claim 4, wherein the guiding base is integrally formed with the first casing or the second casing.

6. The crimping hand tool as recited in claim 1, wherein the crimping assembly comprises:

a pair of crimping members, coaxially and pivotally connected to the linking member and slidably coupled to a guiding base of the first body, wherein the crimping members simultaneously enter and leave a crimping slot of the guiding base, and the cable and the housing are configured to move into the crimping slot and to be crimped together by the pair of crimping members.

7. The crimping hand tool as recited in claim 1, further comprising:

a first cutting tool, assembled to the crimping assembly and moving along with the crimping assembly, wherein, while the cable and the housing being crimped together by the crimping assembly, the first cutting tool trims an excess portion of the conducting lines protruding from the housing.

8. The crimping hand tool as recited in claim 1, wherein the guiding structure comprises a reamed slot passing through the first body, the linking member and the crimping assembly are pivoted to each other through a connecting member, and the connecting member is slidably coupled to the reamed slot.

9. The crimping hand tool as recited in claim 1, further comprising:

a first elastic member, connected to the linking member and the first body, wherein the first elastic member constantly drives the crimping assembly to move away from a crimping slot of the first body through the linking member.

10. The crimping hand tool as recited in claim 1, wherein the linking member or the second body has a ratchet structure, and the crimping hand tool further comprises a stopping block rotatably disposed at the second body or the linking member, the stopping block partially interferes with a moving path of the ratchet structure, and when the first body and the second body rotate to be opened or closed to each other, the stopping block temporarily snaps the ratchet structure.

11. The crimping hand tool as recited in claim 10, further comprising:

a second elastic member, connected to the second body and the stopping block, wherein a direction that the second elastic member drives the stopping block is opposite to a direction that the ratchet structure drives the stopping block.

12. The crimping hand tool as recited in claim 1, wherein the guiding structure has two guiding portions different from each other and distant from a pivoting joint of the first body and the second body, one of the guiding portions is configured to guide the crimping assembly, and the other one of the guiding portions is configured to guide the housing and the cable.

13. The crimping hand tool as recited in claim 12, wherein two guiding directions of the two guiding portions are orthogonal to each other.

14. The crimping hand tool as recited in claim 12, wherein the first body has a guiding base, and the guiding base has the two guiding portions.

15. The crimping hand tool as recited in claim 1, wherein the first body has a stripping slot, and the stripping assembly comprises:

a sliding member, slidably disposed in the first body; and a second cutting tool, disposed at the sliding member, wherein when the cable passes through the stripping slot, the sliding member moves towards the cable and clamps the cable between the sliding member and the first body, and the second cutting tool strips the outer insulating jacket of the cable from the conducting lines.

16. The crimping hand tool as recited in claim 15, wherein the first body has a ribbed plate, the sliding member and the ribbed plate form the stripping slot, and the second cutting tool is disposed in the stripping slot.

17. The crimping hand tool as recited in claim 16, wherein the peeling assembly further comprises:

a third elastic member, connected to the sliding member and the first body, wherein the third elastic member constantly drives the sliding member to move closer to the ribbed plate.

18. The crimping hand tool as recited in claim 15, wherein the first body has a sliding portion, the sliding member is slidably coupled to the sliding portion, and a pushing portion of the sliding member is exposed from the first body.

19. The crimping hand tool as recited in claim 18, wherein the sliding member is disposed between the linking member and the sliding portion, and a sliding path of the sliding member and a moving path of the linking member do not overlap each other.

* * * * *